United States Patent [19]

Bolt

[11] Patent Number: 4,831,807

[45] Date of Patent: May 23, 1989

[54] PROFILE OPEN/FOLD-UP TRUSS

[76] Inventor: Bernard L. Bolt, Rte. 6, Box 8, Harrisonburg, Va. 22801

[21] Appl. No.: 149,442

[22] Filed: Jan. 28, 1988

[51] Int. Cl.[4] ..... E04C 3/02; E04B 1/343

[52] U.S. Cl. ..... 52/641; 52/646; 52/648; 403/53; 403/62; 403/100

[58] Field of Search ..... 135/106–113; 403/100, 53, 62; 405/252; 52/301, 66, 71, 639–642, 726, 645–648

[56] References Cited

U.S. PATENT DOCUMENTS

| | | | |
|---|---|---|---|
| 586,889 | 7/1897 | Williams | 403/102 |
| 907,032 | 1/1908 | Gohen | 135/109 |
| 1,285,467 | 11/1918 | Thiessen et al. | 52/71 |
| 1,488,772 | 4/1924 | Altnow | 403/62 |
| 1,730,267 | 10/1929 | Chittim | 135/113 |
| 2,151,467 | 3/1939 | Harsin | 403/100 |
| 2,473,076 | 6/1949 | Scheibner | 135/112 |
| 2,642,825 | 6/1953 | McElhone et al. | 52/641 |
| 3,404,496 | 10/1968 | Ballard | 52/641 |
| 3,485,346 | 12/1969 | Ballard | 52/645 |
| 3,557,500 | 1/1971 | Schmidt et al. | 52/69 |
| 3,605,355 | 9/1971 | Solesbee | 52/641 |
| 3,638,373 | 2/1972 | Chapman | 52/641 |
| 3,662,502 | 5/1972 | Wright | 52/93 |
| 3,701,225 | 10/1972 | Perry | 52/71 |
| 3,712,006 | 1/1973 | Bea | 52/71 |
| 3,736,708 | 6/1973 | Chapman | 52/641 |
| 3,811,235 | 5/1974 | Powell | 52/69 |
| 3,826,270 | 7/1974 | Hentges | 52/63 |
| 4,005,556 | 2/1977 | Tuomi | 52/93 |
| 4,096,670 | 6/1978 | Fuller | 52/90 |
| 4,167,090 | 9/1979 | Sanford | 52/641 |
| 4,242,845 | 1/1981 | Osborne, Sr. | 52/79.5 |
| 4,294,050 | 10/1981 | Kandel | 52/93 |
| 4,437,273 | 3/1984 | Helfman | 52/93 |
| 4,479,333 | 10/1984 | Hendrich | 52/741 |
| 4,539,788 | 9/1985 | Buijs | 52/71 |
| 4,555,889 | 12/1985 | Mankowski | 52/726 |
| 4,630,627 | 12/1986 | Windows et al. | 135/112 |

FOREIGN PATENT DOCUMENTS

| | | | |
|---|---|---|---|
| 479761 | 2/1916 | France . | |
| 1086986 | 8/1954 | France | 52/66 |
| 1136783 | 1/1957 | France | 403/100 |
| 215581 | 9/1967 | Sweden . | |
| 127188 | 8/1928 | Switzerland | 52/70 |
| 26765 | of 1904 | United Kingdom | 52/726 |

*Primary Examiner*—James L. Ridgill, Jr.
*Attorney, Agent, or Firm*—Sughrue, Mion, Zinn, Macpeak & Seas

[57] ABSTRACT

A profile open/fold-up truss for use in the building industry comprises: a collapsible roof member; at least one floor beam; a pair of wall studs, each wall stud including top and bottom half studs pivotably connected to opposite ends of the roof member and the floor beam, respectively; a hinge arrangement for pivotably connecting the top and bottom half studs; and a pair of foundation studs pivotably connected to opposite ends of the floor beam to support the truss. The truss is transported to the construction site in a preassembled state and subsequently unfolded to form a complete truss structure requiring minimal on-site labor.

19 Claims, 5 Drawing Sheets

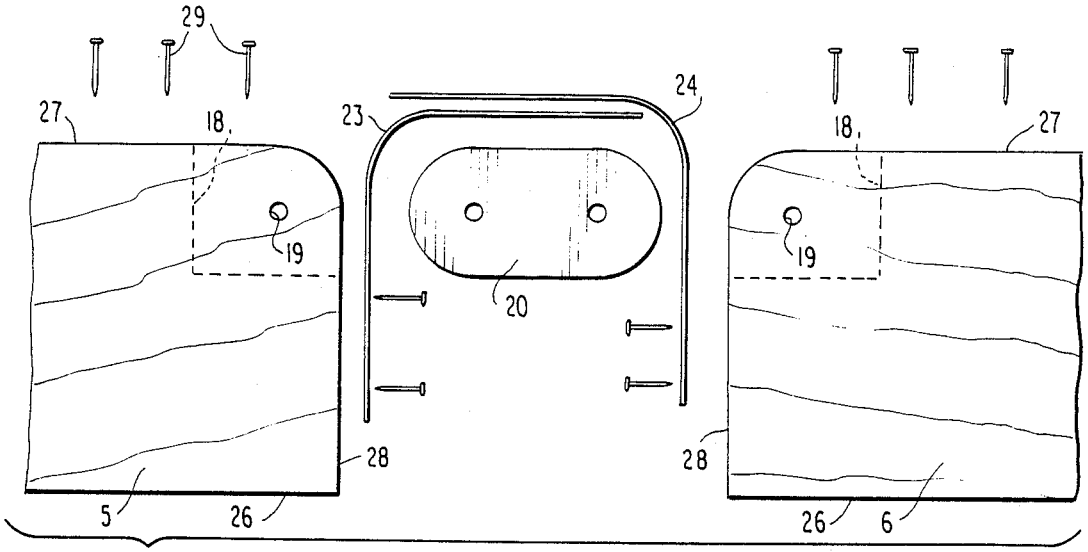
FIG. 7
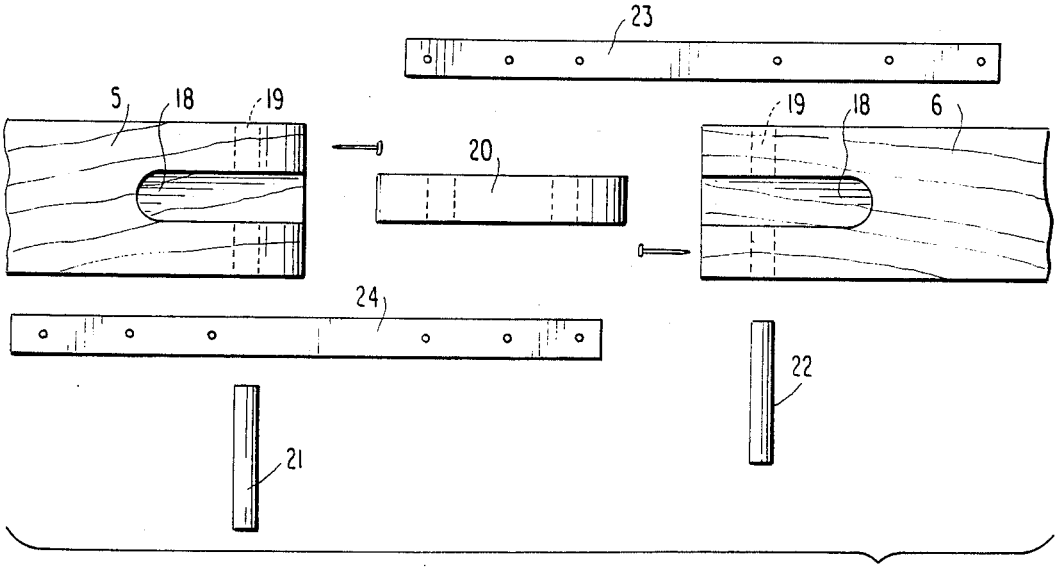
FIG. 8
FIG. 9
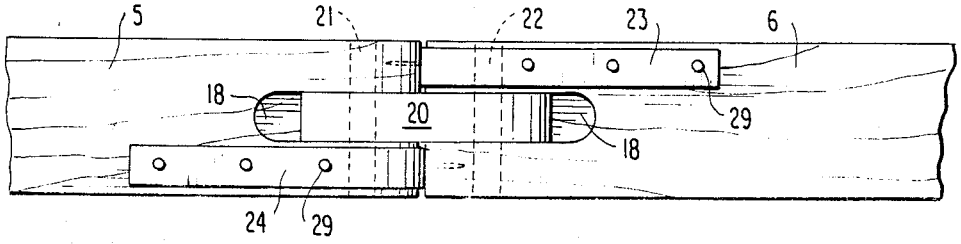

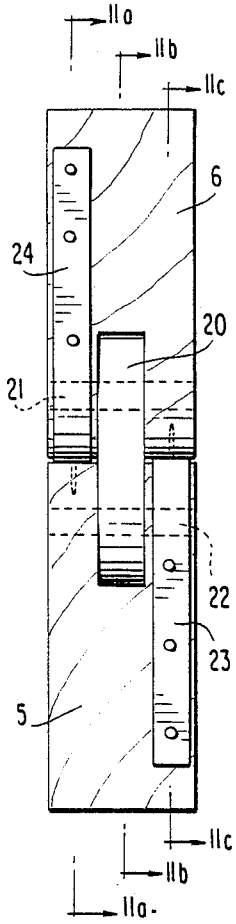
FIG.10
FIG.11a
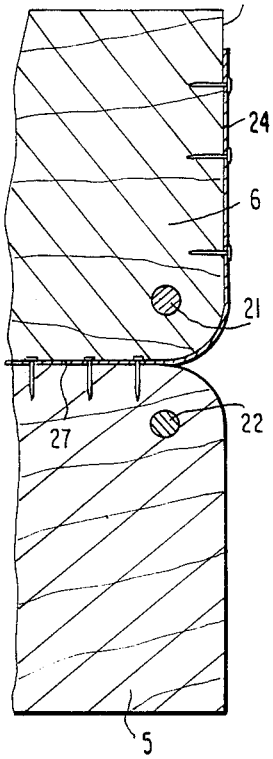
FIG.11b
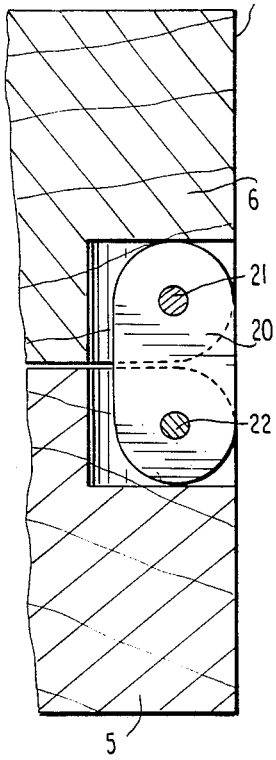
FIG.11c
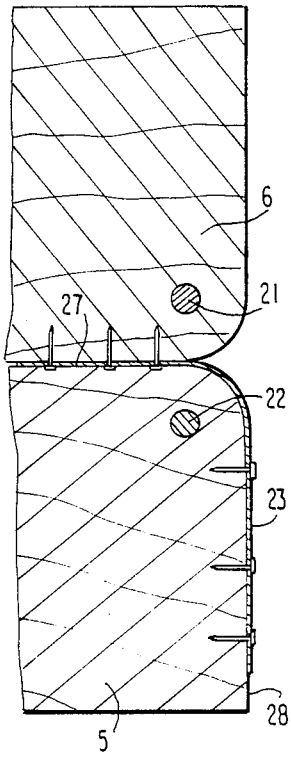
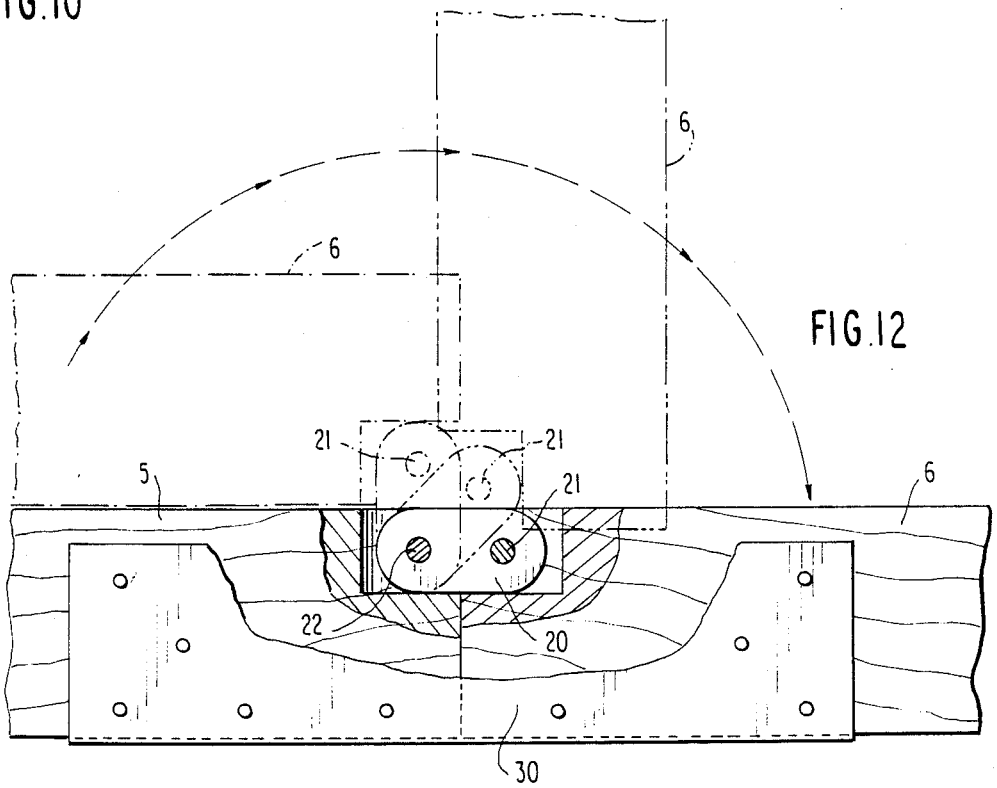
FIG.12

PROFILE OPEN/FOLD-UP TRUSS

BACKGROUND OF THE INVENTION

1. Field of the Invention

The invention relates to building construction, and particularly to an open/fold-up truss used in building construction.

2. Background

Due to the competitive nature of the building industry and the increased cost of labor and materials, it has become necessary to reduce on-site labor by increasing the use of preassembled building components. Accordingly, various preassembled truss structures have been devised to reduce the cost of labor and thereby become more competitive.

Preassembled truss structures generally fall within one of three categories: (1) rigid; (2) knock-down; and (3) open/fold-up. Examples of the rigid type of truss structure are disclosed in Helfman, U.S. Pat. No. 4,437,273 and Tuomi, U.S. Pat. No. 4,005,556. The rigid type of truss structure is completely preassemble prior to shipping such that the individual frames are erected without any on-site assembly. Accordingly since the frames are essentially shipped in their erected state transportation becomes a significant problem. Therfore, to obviate this problem, the knock-down and open/-fold-up type truss structures have been devised to limit the overall shipping dimensions of the truss structure.

Examples of knock-down type truss structures are disclosed in Sanford, U.S. Pat. No. 4,167,090; Wright, U.S. Pat. No. 3,662,502; Fuller, U.S. Pat. No. 4,096,670; and Kandel, U.S. Pat. No. 4,294,050. The knock-down type truss is partially assembled prior to shipping to include individual truss structures such as, for instance, a roof truss and a floor truss. After being transported to the job site, the individual truss structures (i.e., the roof truss and the floor truss) are then assembled to form the completed truss structure. While these knock-down type trusses reduce the problem associated with their transportation they require substantial on-site labor to connect the separate portions of the complete truss structure to form a single structure.

The open/fold-up type truss structure reduces the transportation problem without requiring the on-site labor associated with the knock-down truss. The open/-fold-up type truss structure is preassembled and shipped in a collapsed state. Once on the building site, the truss structure is then unfolded and secured in an erected position. Examples of open/fold-up trusses are disclosed in Mankowski, U.S. Pat. No. 4,555,889; Solesbee U.S. Pat. No. 3,605,355; Perry, U.S. Pat. No. 3,701,225; McElhone, U.S. Pat. No. 2,642,825; and Osborne, U.S. Pat. No. 4,242,845.

Mankowski teaches a collapsible wall stud. Solesbee and Perry disclose a collapsible roof assembly. McElhone teaches a foldable roof truss which includes stud supports. Finally, Osborne discloses a hinge arrangement to which wall panels are attached and swung into position as the roof panel is raised. As can be seen, these arrangement are directed solely to roof trusses and stud supports thereby limiting the extent to which open/-fold-up type trusses can be utilized. It is to an improved open/fold-up type truss structure to which the subject invention is directed. The profile open/fold-up truss, hereinafter referred to as POP truss, of the present invention overcomes the aforementioned disadvantages associated with the prior art trusses.

SUMMARY OF THE INVENTION

It is an object of this invention to provide a preassembled truss structure which is easily transportable.

It is further an object to provide a preassembled truss structure that is foldable and compactable for easier handling.

A further object is to provide a preassembled truss structure which can easily and simply be unfolded for erection at the field site.

Still another object is to provide a preassembled truss structure which results in lower on-site labor costs.

Yet another object is to provide a preassembled truss structure which includes a roof truss and a floor truss.

These and other objects, which will become apparent from the ensuing description of the preferred embodiment of the invention are accomplished according to the present invention by a POP truss comprising a collapsible roof member, at least one floor beam to be connected to the roof member, a pair of wall studs each wall stud comprising top and bottom half studs, top half studs being pivotably connected at one end thereof to the roof member and bottom half studs being pivotably connected at one end thereof to the one floor beam, and a hinge arrangement for pivotably connecting each top half stud to a bottom half stud at the other respective end thereof such that the truss may be arranged in a fold-up position or an open position.

When the POP truss is in the open position, the top and bottom half studs are arranged perpendicular to the floor beam with the top half stud above and in contact with the bottom half stud. When the truss structure is in the fold-up position, the top and bottom half studs are arranged parallel to the floor beam, with the top half stud adjacent the bottom half stud.

When the building design calls for more than one floor beam, additional floor beams are provide,, each additional floor beam being pivotably connected to another floor beam in the same manner that the one floor beam is pivotably connected to the roof member. That is, the top half studs are pivotably connected to a higher floor beam and the bottom half studs are pivotably connected to another lower floor beam and the hinge arrangement pivotably connects the top and bottom half stud members.

BRIEF DESCRIPTION OF THE DRAWINGS

FIG. 7 is a side view of the 180° double pin roll joint of the present invention in the disassembled state;

FIG. 8 top view of the 180° double pin roll joint of the present invention in the disassembled state;

FIG. 9 is a top view of the 180° double pin roll joint of the present invention in the assembled state;

FIG. 10 is an end view of the 180° double pin roll joint of the present in the folded stage;

FIGS. 11*a*, 11*b*, and 11*c* are cross-sectional views of the 180° double pin roll joint of the present invention taken along, the sections shown in FIG. 10; and FIG. 12 is a side view of the 180° double pin roll joint showing various folding/unfolding stages.

DESCRIPTION OF THE PREFERRED EMBODIMENT

Figure 1:
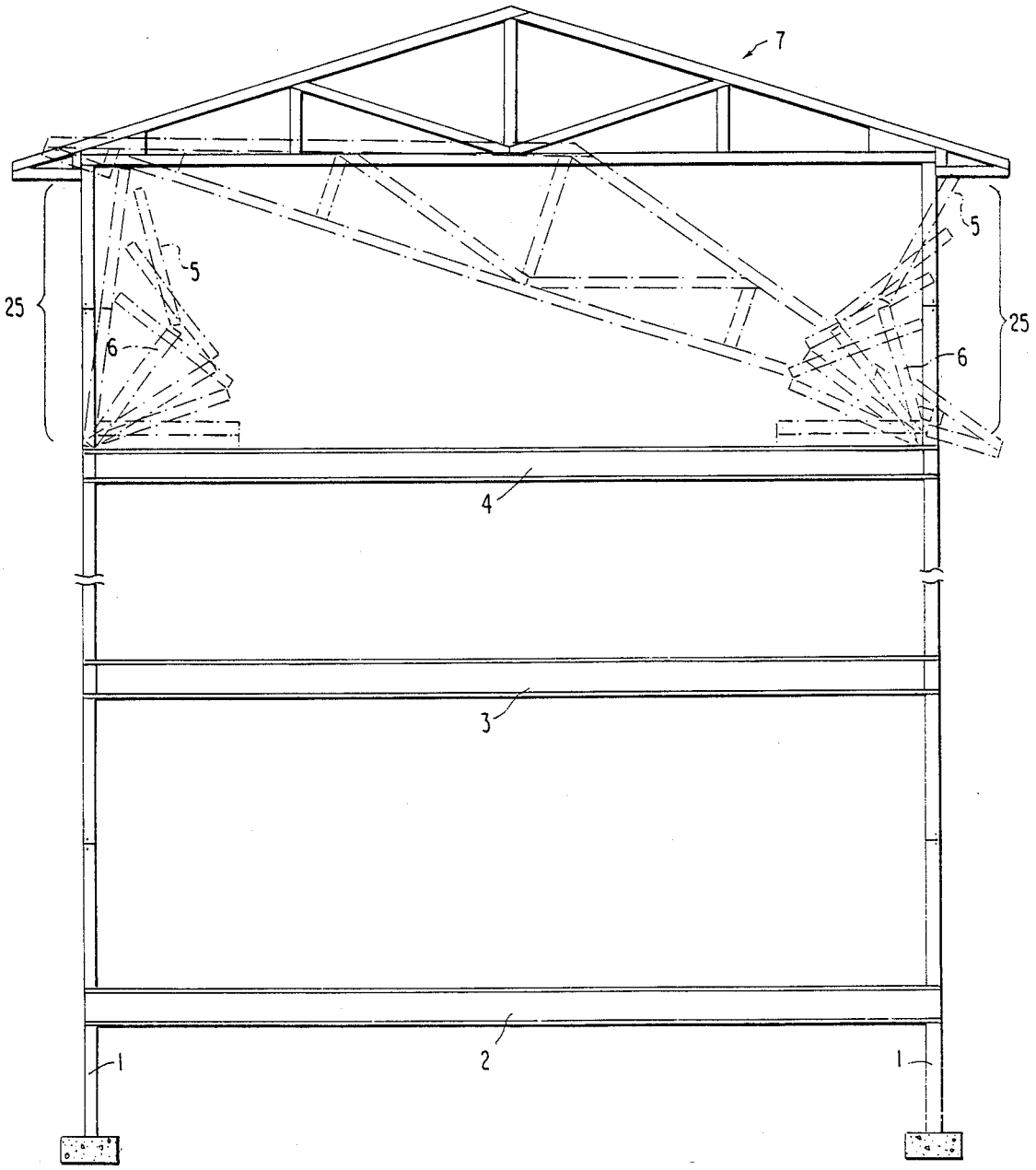
FIG. 1 is a side view of the POP truss of the present showing the final stage of erection.

With reference to FIG. 1, the POP truss of the invention has at least one floor beam although for purposes of illustration a construction with at least three floor beams is illustrated. Above a floor beam 4 is a roof member 7 and below floor beam 4 is another floor beam 3. A floor beam is connected to other floor beams or the roof member through unique hinged half studs forming a portion of the invention.

More particularly, and again referring to FIG. 1, a POP truss according to the teachings of the subject invention may include a pair of foundation studs 1; first, second and third floor beams 2, 3 and 40 respectively; a pair of wall studs 25, each comprising top and bottom half studs 5 and 6, respectively; and roof member 7. The foundation studs 1 are pivotably connected to opposite ends of first floor beam 2. The floor beams are pivotably connected to adjacent floor beams by top and bottom half studs 5 and 6 which are pivotably connected by a hinge arrangement 8. Similarly, the roof member 7 is pivotably connected to the top floor beam 4 by top and bottom half studs 5 and 6 which are pivotably connected by hinge arrangement 8. Although FIG. 1 specifically illustrates roof and floor beams, the POP truss of the subject invention is generally applicable to all types of supporting members.

A building frame comprises a plurality of such trusses positioned in a parallel spaced apart relationship. However, the following discussion is directed to a single truss according to the teachings of inventors.

Figure 2:
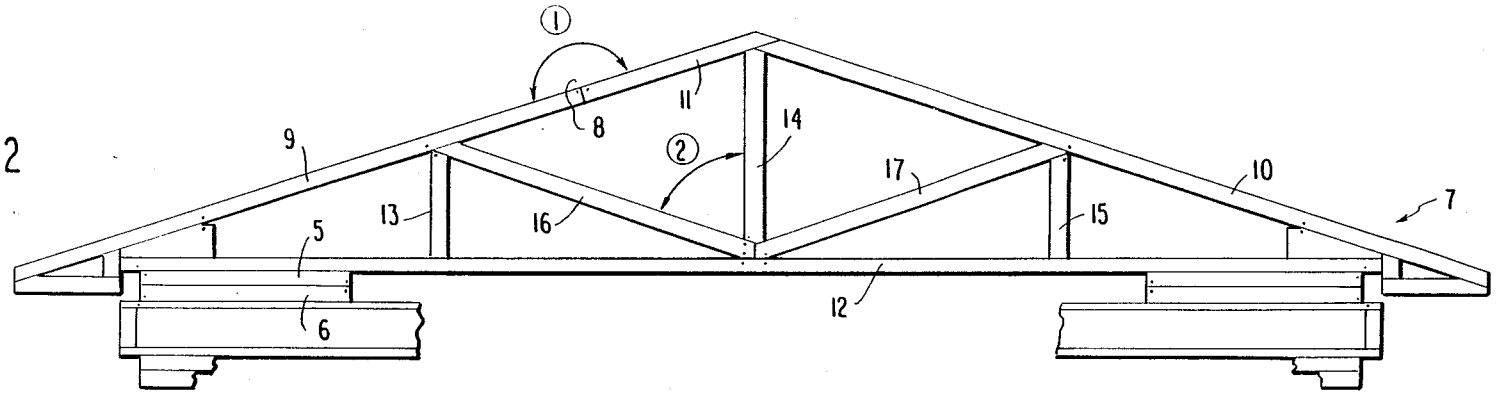
FIGS. 2 through 5 are side views of the roof member of the POP truss of the present invention at various folding/unfolding stages.
Figure 3:
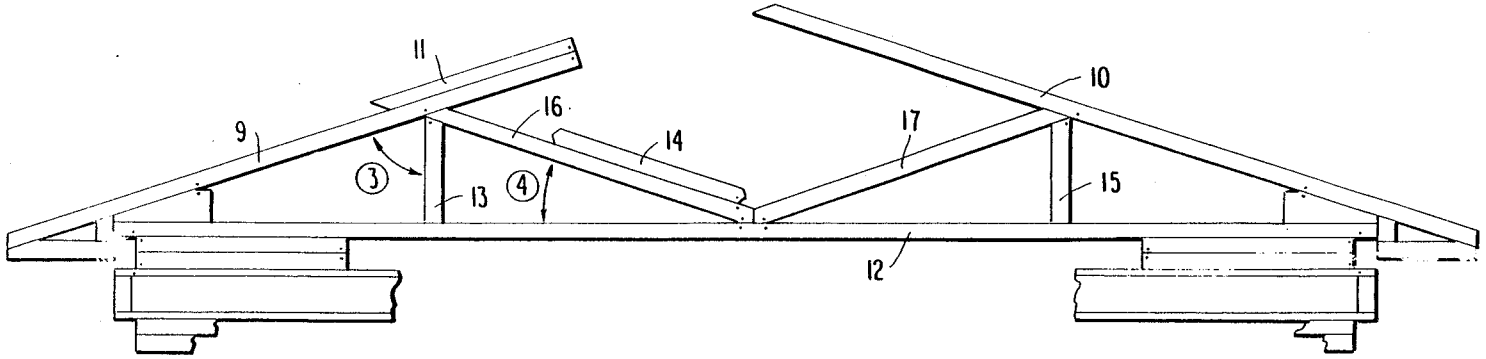
Figure 4:
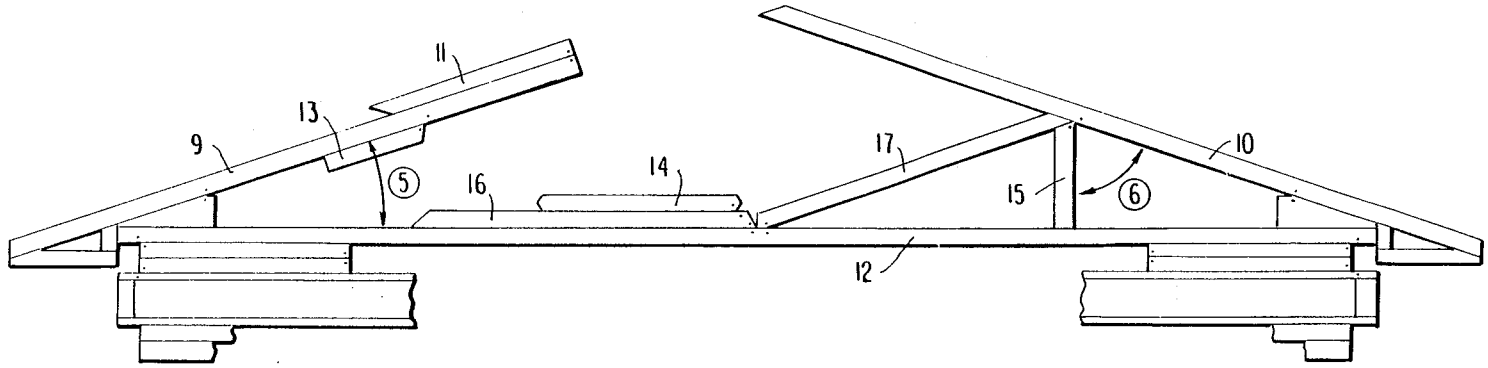
Figure 5:
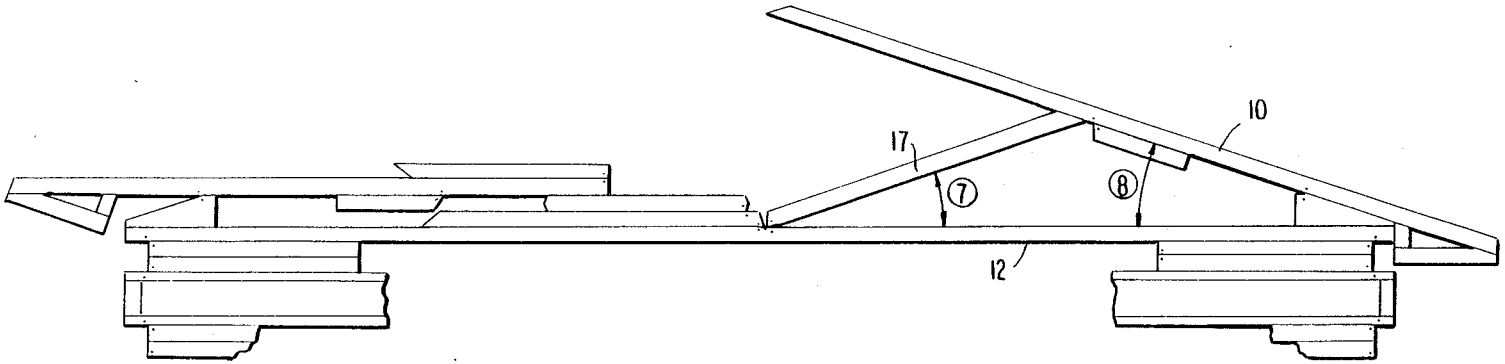

FIG. 2 shows a collapsible roof member 7 according to the further teachings of the invention. The roof member 7 includes first, second and third rafter members 9, 10 and 11, respectively; joist member 12; vertical support members 13, 14 and 15; and diagonal support members 16 and 17. One end of first and second rafter members, 9 and 10 respectively, is pivotably supported at respective opposite ends of joist member 12. Third rafter member 11 is pivotably connected at one end to the other end of first rafter member 9 by hinge arrangement 8, similar to the hinge arrangement connecting the top and bottom half studs, discussed in detail herein below.

In the erect position the other ends of second and third rafter members, 10 and 11, respectively, are abutting at the apex of the roof. The rafter members are supported by the vertical and diagonal support members. Vertical support member 13 is pivotably connected at one end to first rafter member 9. End portions of vertical support member 14 and diagonal support members 16 and 17 are pivotably connected to a midportion of joist member 12. Finally vertical support member 15 is pivotably connected at one end to a midportion of second rafter member 10.

In preparation for transportation of the POP truss, the truss is folded in an accordian-like fashion. First, the roof member 7 is folded according to the following eight step procedure, as illustrated in FIGS. 2–6.

First as represented by 1 in FIG. 2 third rafter member 11 is rotated 180° to a position adjacent first rafter member 9. Second, as represented by 2 in FIG. 2 vertical support member 14 is rotated to abut against diagonal member 16. Third, as represented by 3 in FIG. 3, vertical support member 13 is rotated to abut against the underside of first rafter member 9 Fourth, as represented by 4 in FIG. 3, diagonal support member 16, with vertical support member 14 lying thereon, is rotated to a position parallel to joist member 12. Fifth, as represented by 5 in FIG. 4, first rafter member 9, supporting vertical support 13 and third rafter member 11 in a parallel arrangement, is rotated to a position parallel to joist member 12 and supported by vertical support member 14. Sixth, vertical support member 15 is rotated to abut against the underside of second rafter member 10, as represented by 6 in FIG. 4. Seven, as represented by in FIG. 5, diagonal support member 17 is rotated to abut joist member 12. Eight as represented by 8 in FIG. 5, second rafter member 10, with supporting vertical support 15, is rotated to a position parallel to joist member 12 and supported by vertical member 14.

After the roof member has been folded according to the above procedure, the folded roof member 7 and the floor beams 2, 3, 4 are folded into the final collapsed position as follows. The pairs of top and bottom half studs 5, 6 interconnecting the folded roof member and the floor beams are pivotably rotated about hinge arrangement 8 such that the half studs 5, 6 buckle inwardly toward the interior of the truss structure, as shown in FIG. 6.

Figure 6:
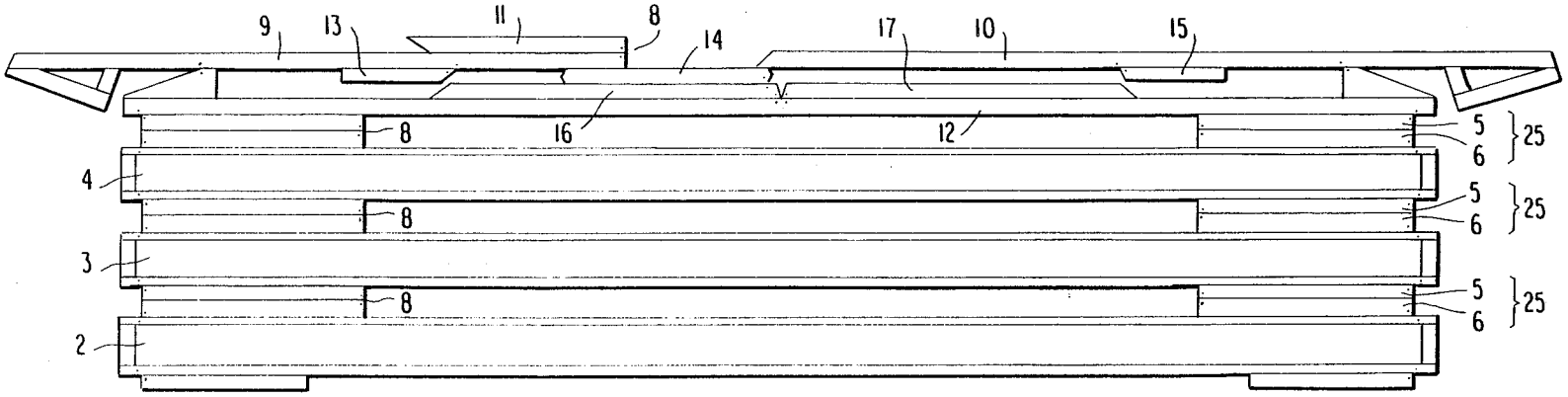
FIG. 6 is a side view of the entire POP truss of the subject invention in the folded mode.

FIG. 6 shows the POP Truss in the folded position where all truss members are in parallel relationship to one another. As can be seen, in its folded position, the POP truss is extremely compact allowing for transportation by standard means.

Upon arrival to the construction site, a plurality of POP trusses are positioned in parallel spaced apart relationship upon a footing or foundation while in their folded or collapsed, mode and laterally connected to each other. Once positioned, the roof members of each truss are unfolded in reverse order from the folding procedure, discussed above, to form a peaked roof structure.

Referring again to FIGS. 2–4, the roof member is unfolded as follows. Firstly the second rafter member 10 is pivotably rotated about joist member 12 and supported by diagonal support member 17 and vertical support member 15. Next first rafter member 9 is pivotably rotated about joist member 12 and supported by diagonal support member 16 and vertical support member 13. Next, vertical support member 14 is rotated about the midportion of joist member 12 to extend perpendicular thereto. Finally, third rafter member 11 is rotated about the end portion of first rafter member 9 to extend therefrom and be supported by vertical support member 14 and second rafter member 10. Each of the members are fixedly secured in their unfolded position by gusset plates attached at the end of their rotational motion and rigidly affixed by fasteners.

Once the roof member of a POP truss is unfolded, it is raised, automatically unfolding and positioning the top and bottom half studs, connecting the roof member to the top floor and interconnecting the other floors. In a multi-story structure the upper floor beam when raised will also automatically unfold, in accordian-like fashion and position the half studs to form full length studs connecting the lower floor beams, as shown in FIG. 1. A holding bracket 30 shown in FIG. 12 is attached to the hinge arrangement 8 to secure the half studs in the unfolded, extended position.

The unique hinge arrangement 8 allows for this accordian-type POP truss. Specifically FIG. 7, which is an exploded view of portions of a paired top and bottom half stud, shows the manner in which the hinge arrangement 8 allows the top and bottom half studs 5, 6 to pivotably connect roof member 7 to floor beam 4 and adjacent floor beams 2, 3, 4 to each other. As shown in FIG. 7, each half stud comprises an inside surface 26 facing towards the interior of the truss, an outside surface 27 facing towards the exterior of the truss and a butt end 28 where the top and bottom half studs abut each other in their unfolded state. The corner portion of each stud, defined by the outside surface and the butt end of the stud, is rounded and includes a slotted portion 18 formed in the center of the respective surfaces as shown in FIGS. 7 and 8, respectively. The slotted portion 18 includes through holes 19, extending perpendicular thereto, for receiving pins 21, 22 which pivotably connect a connector link 20 to the top and bottom half studs 5 6, discussed in detail below.

The hinge arrangement 8 which is a 180° double pin positive roll joint (DPJ), hereinafter referred to as roll joint 8, will be described in further detail with reference to FIGS. 7–12. FIGS. 7 and 8 show the roll joint 8 in a disassembled state. The roll joint 8 comprises connector link 20, pins 21, 22 and tension interfaces 23, 24.

FIG. 9 shows the roll joint in an assembled state. Referring to FIG. 9. connector link 20 is pivotably connected within the slotted portion of the top and bottom half studs 5, 6 by means of receiving pins 21, 22, respectively. Tension interface strap 23 is arranged on one lateral side of the connector link 20 and runs between the rounded corner surfaces of the studs. Opposite ends of the tension interface strap 23 are respectively attached to the back side of half stud 6, shown in FIG. 9, and to the butt end of half stud 5, shown in FIG. 10, by brads 29, or the like.

Tension interface strap 24 is similarly attached but on the opposite lateral side of the connector link 20 and to opposing studs. That is, opposite ends of tension interface 24 are respectively attached to the back side of half stud 5 and the butt end of half stud 6, as shown in FIGS. 9 and 10, respectively. The tension interfaces 23, 24 are unattached at the rounded portions of the half studs 5, 6.

FIG. 11*a* through 11*c* are cross-sectional views of sections defined in FIG. 10, of the hinge arrangement 8 in a folded position. FIG. 11*a* shows tension interface strap 24 connected to the outside surface 27 of half stud 5 and the butt end 28 of half stud 6. FIG. 11*b* shows the connector link 20 connecting half stud 5 to half stud 6. FIG. 11*c* shows tension interface strap 23 connected to the outside surface 27 of half stud 6 and the butt end 28 of half stud 5.

This X-like arrangement creates a rolling transfer line where one face of respective straps unwraps from the rounded corner surface of respective studs while the opposite face of the respective straps wraps around the rounded surface of the other respective studs. The two tension interface straps perform the same functions simultaneously at all points during the entire 180° rotation. That is, the tension interface straps cooperate in a flexible and opposing manner so as to create a constant restraining force between the half studs in both an opening and closing rotation about the connector link. Furthermore, the tension interface straps allow the studs to pivot about the connector link in a smooth, controlled manner with little friction or slippage. The tension interfaces straps may be made of 0.010" stainless steel, or the like, to provide high tensile strength and a virtually frictionless joint.

FIG. 12 shows various folding stages between the full 180° of rotation of the double pin positive roll joint, according to the subject invention. Specifically, FIG. 12 shows the roll joint in the folded, partially folded and unfolded positions. In addition, FIG. 12 shows the holding bracket 30 which secures the top and bottom half studs in the unfolded, extended position.

Accordingly, the subject invention provides an improved open/fold-up truss comprising a collapsible roof member, at least one floor beam, top and bottom half studs, the top half studs being pivotably connected to opposite ends of the roof member and the bottom half studs being pivotably connected to opposite ends of the floor beam and a hinge arrangement for pivotably connecting the top and bottom half studs such that the truss may be arranged in a fold-up position or an open position.

Although the present invention describes the preferred embodiment of the invention, it should be understood that numerous structural modifications and adaptations may be resorted to without departing from the spirit or scope of the invention. For example, the double pin roll joint arrangement could be used as a means to support collapsible structures in general and is therefore not limited to the structure disclosed in the subject application. Furthermore, the top and bottom half stud arrangement could be used for interior wall studs, as well as exterior side wall studs.

The present invention provides a solution to the problems associated with the previous truss structures. While each of the prior art structures are limited to the degree in which the truss structure can be preassembled, the subject invention provides a completely preassembled, fold-up truss structure including a roof member, wall studs floor beams and foundation studs. Accordingly, the fold-up truss, according to the present invention, results in a substantial cost reduction associated with transportation and labor.

What is claimed is:

1. An openable/collapsible truss, comprising;

a collapsible roof member having an a floor beam horizontally oriented and vertically spaced from said collapsible roof member;

a pair of horizontally spaced, vertically oriented wall studs, each wall stud comprising top and bottom half studs, said top half stud being pivotally connected to said chord of said collapsible roof member and said bottom half stud being pivotally connected to said floor beam; and hinge means for rotatively connecting said top and bottom half studs such that said truss may be arranged in a collapsed, folded-up position or in an open, unfolded position.

2. The truss according to claim 1, wherein said top and bottom half studs are arranged perpendicular to said floor beam, said top half studs being directly above and in contact with said bottom half studs, in said open, unfolded position.

3. The truss according to claim 1, wherein said top and bottom half studs are arranged parallel to said floor beam, said top half stud is adjacent said bottom half stud, in said fold-up position.

4. The truss according to claim 1, further comprising foundation studs pivotably connected to said floor beam.

5. The truss according to claim 1, further comprising;

at least one additional floor beam;

another pair of wall studs corresponding to said each additional floor beam, each wall stud comprising top and bottom half studs, said top half stud being connected to said floor beam and said bottom half stud being pivotably connected to said one additional floor beam; and additional hinge means for rotatively connecting said top and bottom half studs such that said truss may be arranged in said fold-up position or in said open, unfolded position.

6. The truss according to claim 1, wherein said collapsible roof member comprises, a joist member;

rafter members pivotably connected to opposite ends of said joist members;

vertical support members pivotably connected to at least one of said rafter members and said joist member; and diagonal support members pivotably connected to said joist member wherein said collapsible roof member may be arranged in said fold-up position or in said open, unfolded position.

7. The truss according to claim 6, wherein said joist member rafter members, and vertical and diagonal support members are arranged parallel to said floor beam in said fold-up position.

8. The truss according to claim 1, wherein said studs have an outside surface extending longitudinally thereto and a butt end at one end thereof, and wherein said hinge means comprises;

a connector link pivotably connecting said top and bottom half studs; and first and second tension interface straps, opposite ends of said first interface straps being attached to said outside surface of said top half studs and to said butt end of said bottom half studs. respectively, and opposite ends of said second interface straps being attached to said outside surface of said bottom half studs and to said butt end of said top half studs, respectively.

9. The truss according to claim 8, wherein said first and second interface straps are arranged on opposite lateral sides of said connector link.

10. The truss according to claim 9, wherein said top and bottom half studs are rotatable from an unfolded position, where the outside surfaces of said top and bottom half studs are abutting to a folded position 180° from said unfolded position, where the outside surface of said top half studs is continuous with the outside surface of said bottom half stud.

11. The truss according to claim 9, wherein a portion of a surface of said studs over which said interface straps pass is rounded such that one face of respective interface straps unwraps from the rounded surface of respective studs while the opposite face of said respective interface straps simultaneously wraps around the rounded surface of respective opposite studs.

12. For use in a open/fold-up truss, a wall stud comprising:

top and bottom half studs, said studs having an outside surface running longitudinally thereto and a butt end at one end thereof;

a connector link pivotably connecting said top and bottom half studs; and first and second tension interface straps. opposite ends of said first interface strap being attached to said outside surface of said top half stud and to said butt end of said bottom half stud. respectively, and opposite end of said second interface strap being attached to said outside surface of said bottom half stud and to said butt end of said top half stud respectively.

13. The wall stud according to claim 12, wherein said first and second interface straps are arranged on opposite lateral sides of said connector link.

14. The wall stud according to claim 13, wherein said top and bottom half studs are rotatable from an unfolded position, where the outside surfaces of said top and bottom half studs are abutting, to a folded position, 180° from said unfolded position, where the outside surface of said top half stud is continuous with the outside surface of said bottom half stud.

15. The wall stud according to claim 14, wherein a portion of said surfaces of said studs over which said interface straps pass is rounded such that one face of respective interface straps unwraps from the rounded surface of respective studs while the opposite face of said respective interface straps simultaneously wraps around the rounded surface of respective opposite studs.

16. A collapsible roof member for an open/fold-up truss comprising:

a joist member;

first and second rafter members, one end of each of said first and second rafter member being pivotably connected to respective opposite ends of said joist member;

a third rafter member pivotably connected at one end thereof to another end of said first rafter member;

first, second and third vertical support members said first and second vertical support members being pivotably connected to said first and second rafter members, respectively, and said third vertical support member being pivotably connected to a center portion of said joist member; and first and second diagonal support members pivotably connected to said center portion of said joist member, wherein said fold-up roof member can be arranged in a fold-up position or an open position.

17. The collapsible roof member for an open/fold-up truss according to claim 16, wherein said rafter members, and vertical and diagonal support members are arranged substantially parallel to said joist member in said fold-up position.

18. A hinge for rotatably connecting a first member and a second member wherein each of said first and second members has a surface running longitudinally thereto and a butt end at one end thereof, and wherein each of said first and second members has a hollowed portion at the butt end thereof, said hinge comprising, a connector link having opposite ends provided in respective hollowed portions of each of said first and second members;

first and second connector pins for pivotably connecting said connector link to said first and second members, respectively; and first and second tension interface straps, opposite ends of said first interface strap being attached to said surface of said first member and to said butt end of said second member, respectively, and opposite ends of said second interface strap being attached to said surface of said second member and to said butt end of said first member respectively.

19. A hinge according to claim 18, wherein said first and second members are top and bottom half studs, respectively of a wall stud for use in an open/fold-up truss.

* * * * *

UNITED STATES PATENT AND TRADEMARK OFFICE
CERTIFICATE OF CORRECTION

PATENT NO. : 4,831,807

DATED : May 23, 1989

INVENTOR(S) : Bernard L. Bolt, Harrisonburg, VA

It is certified that error appears in the above-identified patent and that said Letters Patent is hereby corrected as shown below:

Column 2, line 39, change "provide,," to --provided,--;
line 51, after "present", insert --invention--.

Column 3, line 17, change "40" to --4--.

Column 4, line 11, after "by", insert --7--.

Column 6, line 33, after "studs" (first occurrence), insert --,--;
line 39, after "an", insert --elongate horizontally oriented chord;--.

Signed and Sealed this

Sixth Day of February, 1990

*Attest:*

JEFFREY M. SAMUELS

*Attesting Officer* *Acting Commissioner of Patents and Trademarks*